US010100688B2

(12) United States Patent
Imfeld et al.

(10) Patent No.: US 10,100,688 B2
(45) Date of Patent: Oct. 16, 2018

(54) DAMPER ASSEMBLY FOR A COMBUSTION CHAMBER

(71) Applicant: ANSALDO ENERGIA SWITZERLAND AG, Baden (CH)

(72) Inventors: Jost Imfeld, Scherz (CH); Roger Ernst, Rüfenach (CH); Laurent Fabien Laville, Niedergösgen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 50 days.

(21) Appl. No.: 15/285,887

(22) Filed: Oct. 5, 2016

(65) Prior Publication Data

US 2017/0096919 A1 Apr. 6, 2017

(30) Foreign Application Priority Data

Oct. 5, 2015 (EP) ..... 15188366

(51) Int. Cl.

| | |
|---|---|
| ***F01N 1/02*** | (2006.01) |
| ***F23R 3/42*** | (2006.01) |
| ***G10K 11/16*** | (2006.01) |
| ***F23M 20/00*** | (2014.01) |

(52) U.S. Cl.

CPC ..... *F01N 1/02* (2013.01); *F23M 20/005* (2015.01); *F23R 3/42* (2013.01); *G10K 11/161* (2013.01); *F01N 2490/12* (2013.01); *F23R 2900/00013* (2013.01); *F23R 2900/00014* (2013.01)

(58) Field of Classification Search

CPC ..... F01N 1/02; F01N 2490/12; F23M 20/005; G10K 11/161; F23R 2900/00014; F23R 2900/00013

USPC ..... 181/216, 241, 263, 267, 271; 123/184.53, 184.54, 184.55, 184.56, 123/184.57

See application file for complete search history.

(56) References Cited

U.S. PATENT DOCUMENTS

| | | | | |
|---|---|---|---|---|
| 4,539,947 | A * | 9/1985 | Sawada | F01N 1/006 123/184.57 |
| 5,475,189 | A * | 12/1995 | Field | F16L 55/0333 181/229 |
| 6,633,646 | B1 * | 10/2003 | Hwang | G10K 11/175 181/206 |
| 6,634,457 | B2 * | 10/2003 | Paschereit | F01N 1/02 181/219 |
| 6,698,390 | B1 | 3/2004 | Kostun et al. | |

(Continued)

FOREIGN PATENT DOCUMENTS

| | | |
|---|---|---|
| EP | 0 111 336 A2 | 6/1984 |
| EP | 1 158 247 A2 | 11/2001 |

(Continued)

OTHER PUBLICATIONS

Search Report dated Mar. 23, 2016, by the European Patent Office for Application No. 15188366.

*Primary Examiner* — Forrest M Phillips

(74) *Attorney, Agent, or Firm* — Buchanan Ingersoll & Rooney PC

(57) ABSTRACT

The present disclosure relates to gas turbines and to a damper assembly for a combustion chamber of a gas turbine. A damper assembly as disclosed herein may be adjusted to different frequencies during operation and/or deactivated for different operation regimes.

13 Claims, 8 Drawing Sheets

(56) References Cited

U.S. PATENT DOCUMENTS

| | | | | |
|---|---|---|---|---|
| 6,732,509 | B2 * | 5/2004 | Shiga | F01N 1/02 123/184.53 |
| 6,792,907 | B1 * | 9/2004 | Kostun | F01N 1/02 123/184.57 |
| 7,055,648 | B2 * | 6/2006 | Byrne | F02C 7/045 181/216 |
| 7,334,663 | B2 * | 2/2008 | Nakayama | F02M 35/1255 123/184.55 |
| 7,337,877 | B2 * | 3/2008 | Goenka | F02M 35/1261 123/184.56 |
| 7,350,496 | B2 * | 4/2008 | Nakayama | F02M 35/125 123/184.57 |
| 7,497,300 | B2 * | 3/2009 | D'Angelo | F01N 1/00 181/196 |
| 7,690,478 | B2 * | 4/2010 | Kostun | F02M 35/1255 123/184.57 |
| 8,033,358 | B2 * | 10/2011 | Ivers | B64D 33/02 181/214 |
| 8,727,070 | B2 * | 5/2014 | Huber | F23M 20/005 123/184.55 |
| 2002/0000343 | A1 * | 1/2002 | Paschereit | F01N 1/02 181/229 |
| 2003/0230273 | A1 * | 12/2003 | Koelmel | F02B 27/02 123/184.57 |
| 2005/0205354 | A1 * | 9/2005 | Goenka | F02M 35/1261 181/277 |
| 2015/0059345 | A1 | 3/2015 | Hellat et al. | |

FOREIGN PATENT DOCUMENTS

| | | | |
|---|---|---|---|
| EP | 1 624 251 | A1 | 2/2006 |
| EP | 2 642 204 | A1 | 9/2013 |
| GB | 2 357 141 | A | 6/2001 |
| KR | 2003 0043151 | A | 6/2003 |

* cited by examiner

DAMPER ASSEMBLY FOR A COMBUSTION CHAMBER

FIELD OF THE INVENTION

The present invention generally relates to gas turbines and more in particular it relates to a damper assembly for a combustion chamber of a gas turbine.

BACKGROUND

As well known, in conventional gas turbines, acoustic oscillation usually occurs in the combustion chambers of the gas turbines. With the term chamber is intended any gas volume where combustion dynamics occur. In such chambers the flow of a gas (for example a mixture of fuel and air or exhaust gas) with high velocity usually creates noise. Burning air and fuel in the combustion chamber causes further noise. This acoustic oscillation may evolve into highly pronounced resonance. Such oscillation, which is also known as combustion chamber pulsations, can reach amplitudes and associated pressure fluctuations that subject the combustion chamber itself to severe mechanical loads that may decisively reduce the life of the combustion chamber and, in the worst case, may even lead to its destruction.

To reduce the acoustic oscillations noise it is well known in the art to install acoustic damping devices like Helmholtz resonators.

Typically, these kinds of dampers are physical devices that are often positioned around the combustion chamber (on the liner, on the front panel). They usually include an empty cavity (where air can flow) and a neck that connects the volume of the cavity to the combustion chamber.

The resonance frequency and damping power of a Helmholtz damper assembly depends on its geometry and on the flow through its neck.

Once the Helmholtz damper is selected and its geometry fixed, it provides a specific characteristic to damp certain frequencies with a certain growth rate reduction coefficient. According to the teachings of the prior art, the geometry cannot be changed during rig or engine operation.

To change the frequency, or to deactivate a damper assembly, the rig/engine has to be shut off and partly disassembled. However, it will be appreciated that such procedure is time-consuming and during following test run only one configuration can be tested.

Moreover, in the event that a wrong arrangement is chosen, the following test is useless or even an outage has to be repeated. To reduce the risk of such outages and/or unsuccessful tests, normally several damper assemblies are connected to the combustion chamber. Such methodology might eventually lead to engines having a large number of dampers.

In sum, up to now different damping frequencies are achieved with several damper assemblies. Such damper assemblies are always active whether they are needed or not for a specific operation regime (e.g. gas or oil operation or part or full load). If certain damper assemblies would not be needed during full load, purge air would still cool down the combustor chamber and increase NOx.

SUMMARY OF THE INVENTION

It is an object of the present invention to solve the aforementioned technical problem by providing a damper assembly as substantially defined according to independent claim 1.

According to an aspect of the invention, it is provided a damper assembly for a combustion chamber of a gas turbine, comprising a hollow body provided with a neck and defining at least an internal damper cavity in fluid communication with the combustion chamber through the neck, and wherein the hollow body comprises a movable element adapted to vary a volume of the internal damper cavity.

According to a preferred aspect of the invention, the hollow body comprises stop elements configured to limit a stroke of the movable element.

According to a preferred aspect of the invention, the movable element is adapted to be arranged in a first position correspondent to a maximum volume and in a second position correspondent to a minimum volume of the damper cavity.

According to a preferred aspect of the invention, the hollow body is partitioned into two separate and fluidly communicating first and second damper cavities, wherein the first damper cavity has a fixed volume and the movable member is arranged into the second damper cavity.

According to a preferred aspect of the invention, the movable element may be bucket-shaped.

According to an alternative embodiment, the movable element may be an inner cavity having a fixed volume, in fluid communication with the damper cavity of the hollow body.

According to a preferred aspect of the invention, the damper assembly comprises a plug adapted to be arranged in a first active position correspondent to a maximum volume of the damper cavity in which the combustion chamber is in fluid communication with the damper cavity, and in a second closed position where the plug is inserted into the neck such to deactivate the damper assembly.

According to a preferred aspect of the invention, the plug is mounted on the movable element.

According to a preferred aspect of the invention, the damper assembly comprises a drive arrangement associated to the movable element.

According to a preferred aspect of the invention, the drive arrangement comprises a compressed air feeding system and a sealing element associated to the movable element.

According to a preferred aspect of the invention, the compressed air feeding system (15 is arranged such to feed compressed air in a pressurised volume delimited by a wall of the movable element and an internal wall of the hollow body.

According to a preferred aspect of the invention, the sealing element is adapted to seal the damper cavity from the pressurised volume.

According to a preferred aspect of the invention, the sealing element is a compensator arranged around the movable element and disposed along an internal wall of the hollow body.

According to a preferred aspect of the invention, the sealing element is made of a resilient material.

Advantageously, the damper assembly according to the present invention may be adjusted to different frequencies online and/or deactivated, as it will become apparent with the detailed description of some exemplary and non-limiting embodiments.

Moreover, with such procedure it may also be more exactly evaluated how many damper assemblies are actually needed for stable combustor operations.

It will also be appreciated that the adjustable damper according to the invention allows saving time for testing or may be adjusted to a preferred damping frequency during engine operation for different operation regimes.

BRIEF DESCRIPTION OF DRAWINGS

The foregoing objects and many of the attendant advantages of this invention will become more readily appreciated as the same becomes better understood by reference to the following detailed description when taken in conjunction with the accompanying drawings, wherein.

Preferred embodiments of the present invention will be now described in detail with reference to the aforementioned drawings.

DETAILED DESCRIPTION OF THE INVENTION

Figure 1:
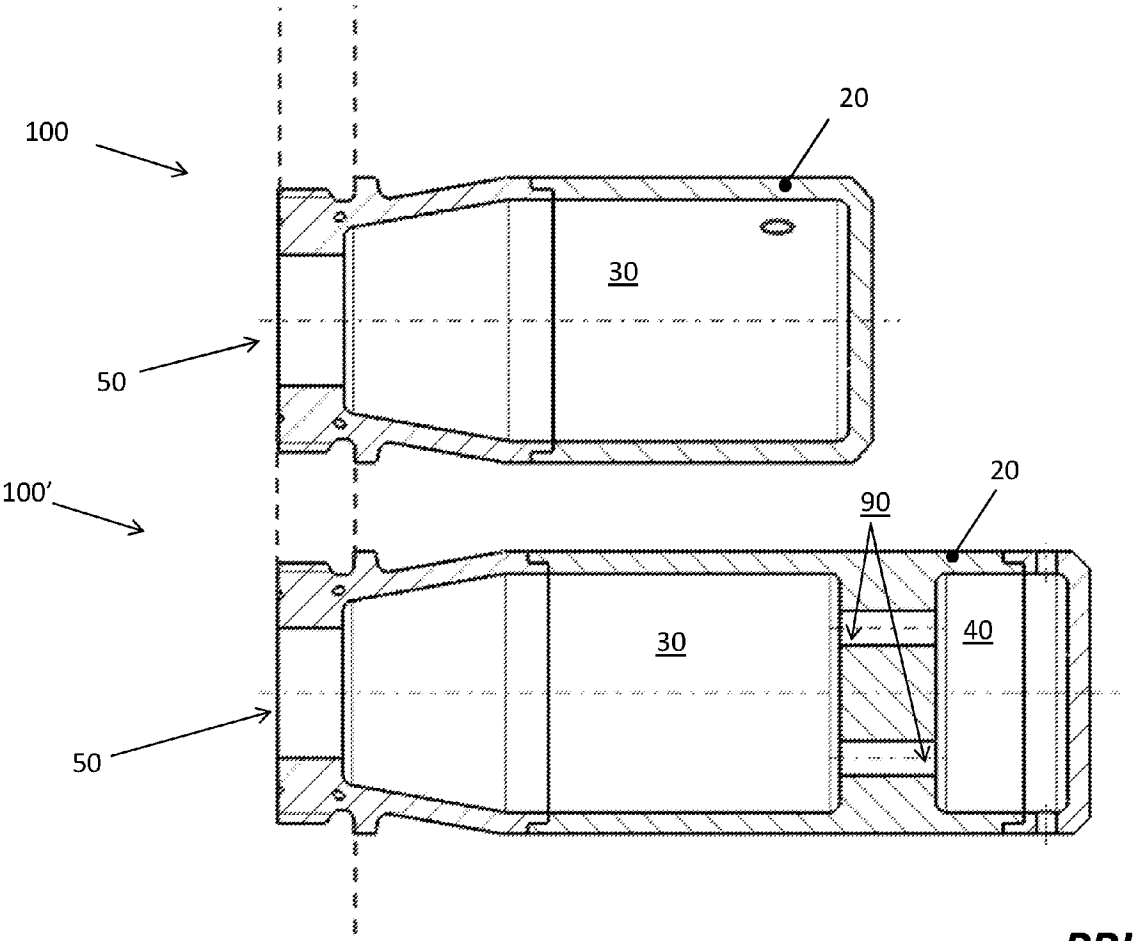
PRIOR ART FIG.1
FIG. 1 shows a lateral section of a single cavity damper assembly (top) and a double cavity damper assembly (bottom) according to the prior art.

With reference to FIG. 1, it is showed a side view of damper assemblies 100 and 100' according to the prior art. In particular, damper assembly 100 comprises a hollow body 20 which defines a single cavity 30, the single cavity having a fixed volume. Damper assembly 100 is in fluid communication with a combustion chamber (not shown) through a neck 50. The damping frequency of damper assembly 100 depends on its geometry, and thus is fixed and cannot be changed during testing or normal operation.

Damper assembly 100' differs from damper 100 in the fact that is a double volume cavity. More specifically, damper assembly 100' includes a hollow body 20 which internally defines two damper cavities 30 and 40, which are in fluid communication through internal ducts 90. Similarly, damper assembly 100' has fixed inner volumes of the cavities, and hence the damping frequency is fixed as well.

Figure 2:
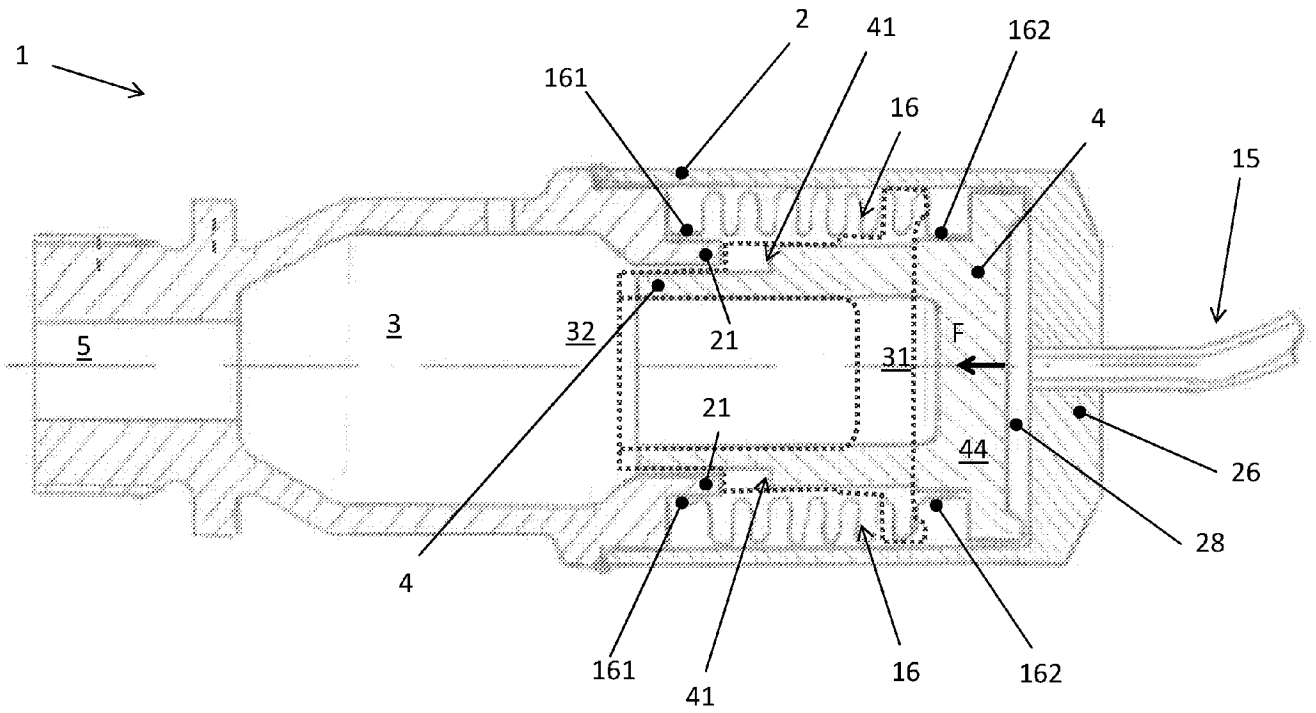
FIG. 2 shows a lateral section of a damper assembly according to a first preferred embodiment of the present invention.

Making now reference to the following FIG. 2, it is shown a lateral section of a damper assembly 1 according to a first exemplary and non-limiting embodiment of the present invention.

Damper assembly 1 comprises a hollow body 2 which defines an internal damper cavity 3. The internal cavity 3 is in fluid communication with a combustion chamber (not shown) through a neck 5, located on the hollow body 2. According to an aspect of the invention, hollow body 2 comprises a movable element which is adapted to vary a volume of the damper cavity 3.

In the first and non-limiting preferred embodiment, the movable element is bucket-shaped and it is indicated with numeral reference 4. The cross-section shown in the figure of the movable element 4 is C-shaped.

The movable element 4 is adapted to be arranged in a first position, which corresponds to a maximum volume 31 of the damper cavity 3, and in a second position (indicated dashed in the figure) corresponding to a minimum volume 32 of the damper cavity 3.

To this end, to the movable element 4 is associated a drive arrangement, which includes a compressed air feeding system, generally indicated with numeral reference 15, and a sealing element 16 which is associated to the movable element 4.

Still with reference to FIG. 2, it is shown the movable element 4 in the first position which corresponds to a maximum volume 31 of the damper cavity 3, which is associated to a first damping frequency. In particular, maximum volume 31 is defined by external walls of the hollow body 2 and the internal walls of the bucket-shaped member 4, located in the hollow body 2.

When it is wished to switch to a second damping frequency, different from the first damping frequency, the air feeding system 15 provides compressed air which is fed into a pressurised gap 28, formed between a wall 44 of the movable member 4 and the back wall 26 of the hollow body 2.

Advantageously, the pressurized gap 26 is sealed by the sealing element 16 from the damper cavity 3. The compressed air fed into the gap 28 pushes the movable member 4 along direction of arrow F until stop elements 21 limit a stroke of the movable element 4. To this end, element 4 includes along its side walls steps 41, which are configured to abut against stop elements 21. When the movable element 4 reaches the second operative condition (dashed in the figure) the steps 41 abut against stop elements 21. The minimum volume 32 of the damper cavity 3, which corresponds to the new position of the movable element 4, substantially equals the maximum volume 31 decreased of the volume of the gap 28 filled with compressed air. The new decreased volume 32, accomplished with the movable member 4 in its second operative position, enables the damper assembly 1 to provide a damping frequency which differs from the damping frequency obtained with the movable member configured in its first operative position.

Hence, advantageously, damper assembly 1 provides the combustion chamber with two different damping frequencies, which are remotely obtainable by driving the compressed air feeding system 15 which in turn acts on the position of the movable member within the damper cavity 3.

According to a preferred and non-limiting embodiment, sealing element 16 is a compensator, which is arranged around the bucket-shaped movable element 4 and disposed along an internal wall of the hollow body 2, as shown in the lateral cross section of FIG. 2.

In particular, compensator 16 is tightly connected, preferably by welding, at a first edge 161 to the hollow body 2 and, at a second edge 162, to the movable member 4.

Generally, the sealing element 16 separates the pressurised gap 28 from the pressure established in or around the combustor chamber, that is the pressure in the damper cavity 3. With the sealing function, the leakage is substantially avoided and the mass flow through the pressure feed pipe 15 is only present during activation/deactivation, but not during stable operation. Advantageously, with such arrangement the pressure feed pipe 15 can be designed with a small size, that is having tubes with a diameter equal or less than 5 mm.

On the contrary, if conventional seals (e.g. piston rings) were used, the leakage would have to be compensated with a certain flow through the pressure line and therefore would require a bigger pipe.

Preferably, the compensator 16 is made of a resilient material, to further offer a spring-like reaction versus the movable element 4 during its stroke.

Figure 3:
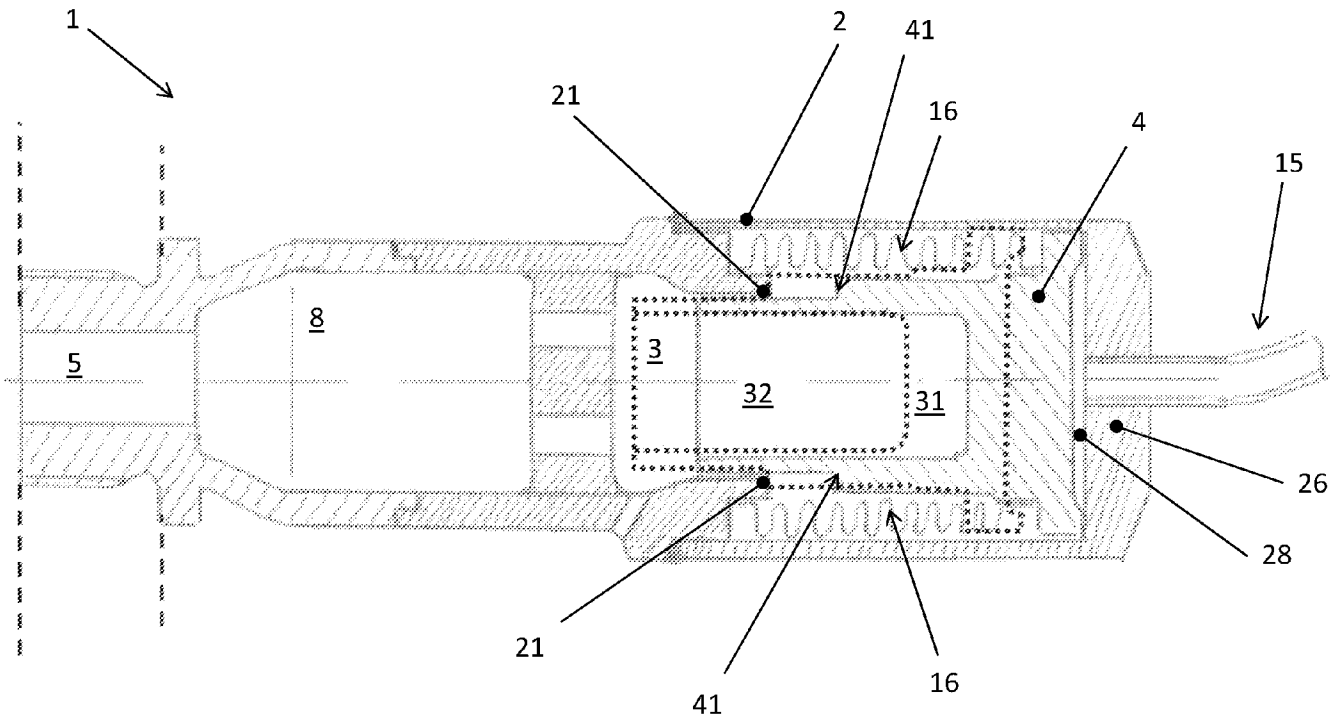
FIG. 3 shows a lateral section of a damper assembly according to a second preferred embodiment of the present invention.

Making now reference to the following FIG. 3, it is shown the damper assembly 1 according to a second exemplary embodiment. This embodiment is equivalent to the first embodiment with the difference that damper assembly 1 is a double cavity assembly. In particular, damper assembly 1 is partitioned into two separate and fluidly communicating damper cavities: a first damper cavity 8 which has a fixed volume, and a second damper cavity 3. The movable member 4 is located inside damper cavity 3 which then has a variable volume. The mode of operation of movable member 4 inside damping cavity 3 in this second exemplary embodiment is equal to the first embodiment above described.

Figure 4:
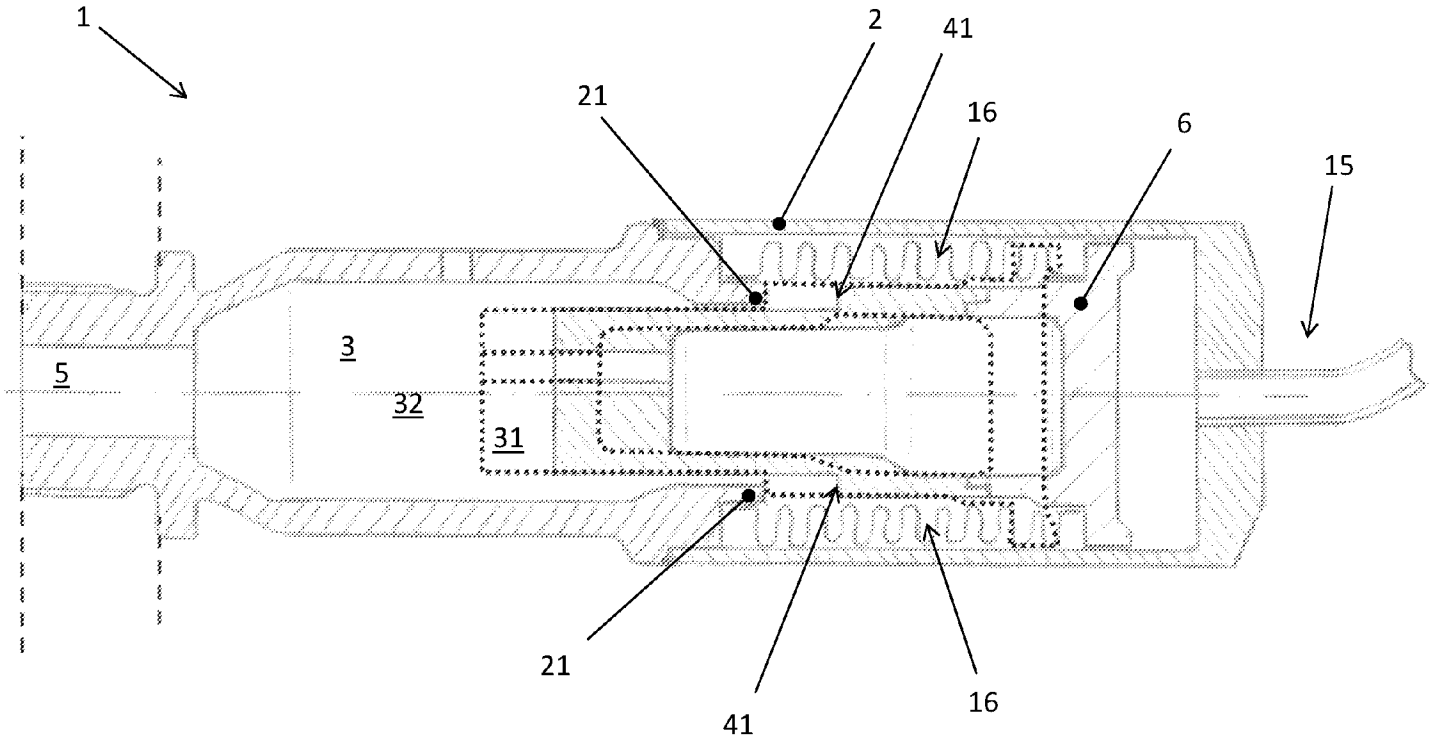
FIG. 4 shows a lateral section of a damper assembly according to a third preferred embodiment of the present invention.

With reference to FIG. 4, it is shown a third preferred embodiment of the present invention.

In this embodiment, the movable element is an inner cavity 6 in fluid communication with damper cavity 3. The movement of the cavity 6 from a first position corresponding to the maximum volume 31 to the second position corresponding to the minimum volume 32 is operated in an analogous way as described for first and second exemplary embodiments.

The inner cavity 6 has a fixed volume, while damper cavity 3 has a variable volume due to the movement of the inner cavity 6 from its first operative position to the second operative position (dashed).

Figure 5:
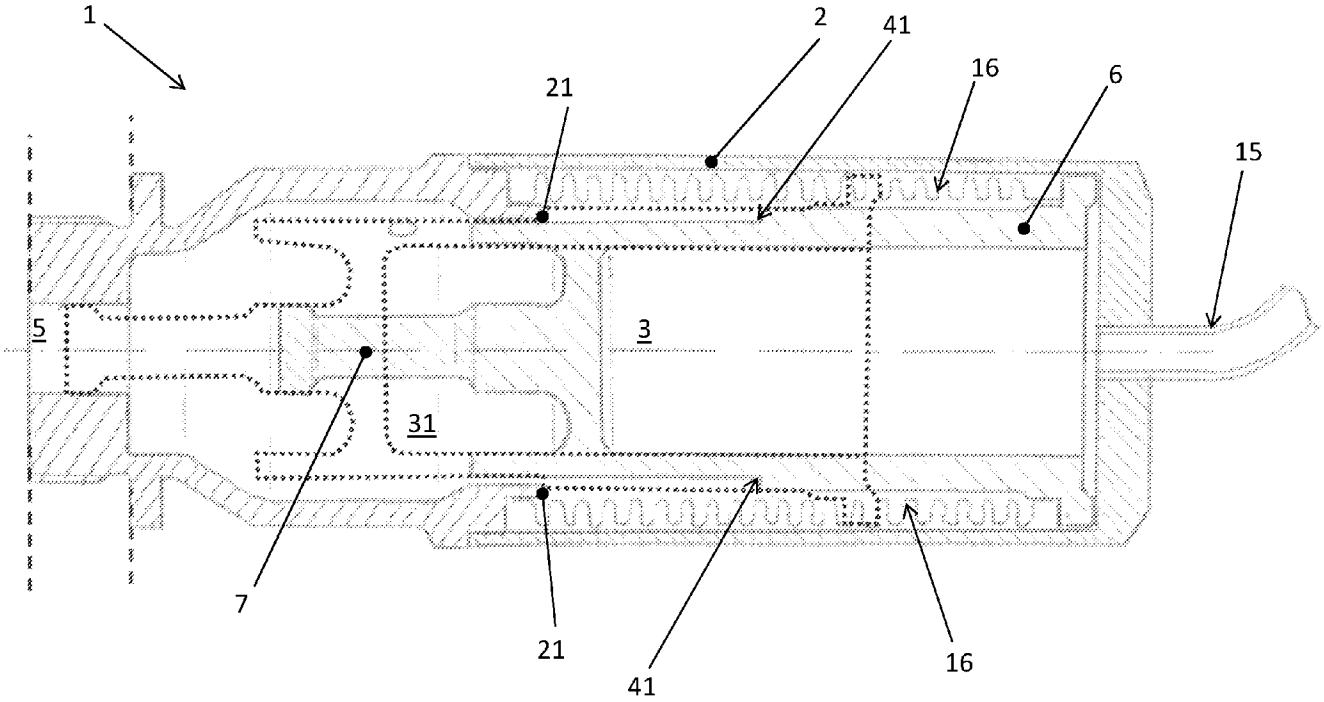
FIG. 5 shows a lateral section of a damper assembly according to a forth preferred embodiment of the present invention.

With now reference to the following FIG. 5, it is shown the damper assembly according to a forth preferred embodiment.

In this forth embodiment, damper assembly 1 comprises a plug 7 which is adapted to be arranged in a first active position in which the damper cavity 3 is in fluid communication with the combustion chamber (not shown) through the neck 5, and in a second closed position wherein the plug 7 is inserted into the neck 5 and obstructs it (position dashed in the figure), such to deactivate the damper assembly 1.

In the preferred and non-limiting example herewith detailed, the plug 7 is mounted on the movable element 6, which in this case is an inner cavity located inside the damper cavity 3. With such arrangement, the damper assembly 1 is a de-activatable damper assembly. However, the movable element may also be bucket-shaped like the first embodiment shown and/or positioned into an associated damper cavity as shown for the second embodiment, or in any other shapes.

In fact, when movable member 6 is in its first operative position, damper cavity 3 is characterised by maximum volume 31 and plug 7 does not engage into the neck 5. Hence, combustion chamber is in fluid communication with damper assembly which operates with a damping frequency which depends on volume 31. When movable member is shifted to its second operative position, the plug 7 is inserted into the neck 5 and obstructs the passage (position dashed in the figure). In this way the damper assembly 1 is deactivated, or, in other words, the minimum volume corresponding to the second operative position of the movable member 6 is equal to zero.

Figure 6:
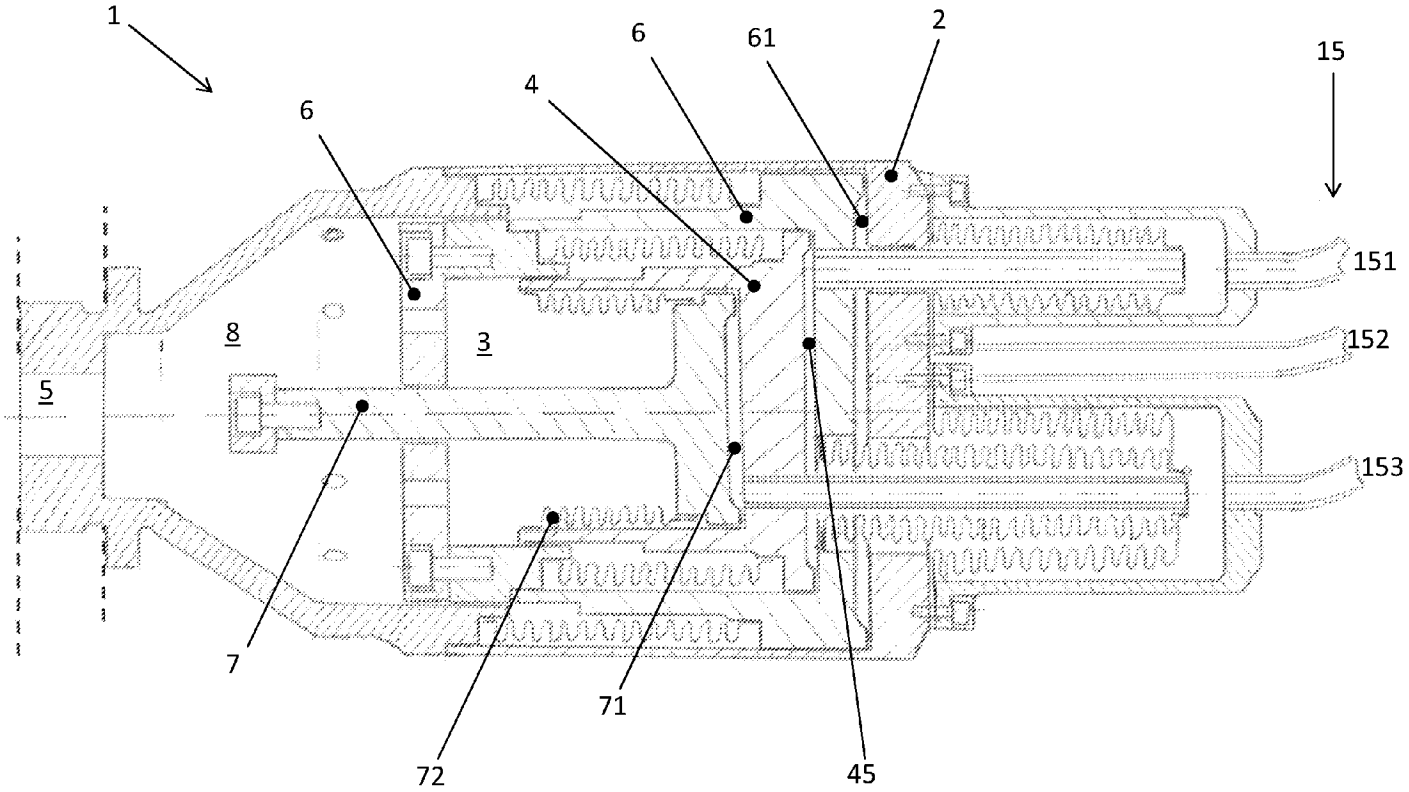
FIG. 6 shows a lateral section of a damper assembly according to a fifth preferred embodiment of the present invention.

With reference to FIG. 6, it is shown the damper assembly 1 according to a fifth embodiment of the present invention. In this embodiment, compressed air feeding system 15 includes separated and independent feeding systems 151, 152 and 153.

In particular, feeding system 153 acts solely on the plug element 7, moving it from an active position when the plug 7 is not inserted into the neck 5, and thus the damper is active, to a deactivated position wherein the plug 7 is inserted into the neck 5. The movement of the plug 7 occurs by means of pressurized air filling a gap 71 which then moves the plug 7 against sealing element 72.

Feeding system 151 acts, in a similar way, on movable member 4, filling gap 45, and varies the volume inside the damping cavity 3.

Lastly, feeding system 152 acts on movable member 6, filling with pressurized air gap 61, and varies the volume of damping cavity 8, operating in an analogous way as described above.

So, advantageously, this embodiment provides a double cavity damper assembly which has both cavities, in fluid communication between each other, having adjustable volumes by means of feeding air system 151 and 152, and also provides the possibility for the damper assembly 1 to be deactivated by means of feeding air system 153 acting on the plug 7.

Figure 7:
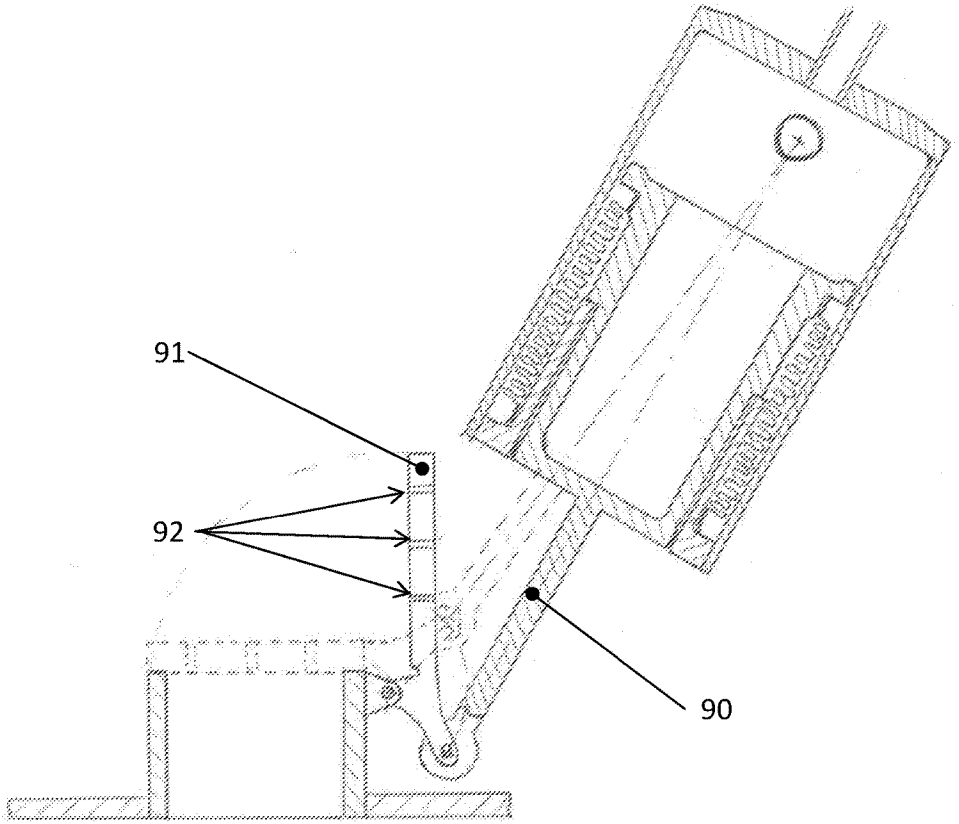
FIGS. 7 and 8 show a different usage of the damper assembly according to the invention when associated to a combustion chamber.

With reference not to FIG. 7, it is shown an alternative usage of the movable element as explained above, to close also very large damper volumes (e.g. Low-Frequency Helmholtz Damper) with the same pneumatic movable piston concept.

In this case the movable element, operating as described above, terminates with a piston 90 which is hinged to a flap 91, which is in turn hinged to a neck 92 of the damper volume. Advantageously, the flap 91 is provided with purge holes 93.

This is advantageous if the damper neck is very large and/or the needed movable range of the movable part exceeds the design limits. In this case, the piston will not directly insert a plug into a neck, but activate a flap to close the neck. With this technique, the damper volume cannot be adjusted, but the damper can be activated/deactivated during rig/engine operation.

Preferably the flap can be rotated around an axis perpendicular to the neck axis or also parallel to it.

Clearly also every other angle can be imagined.

Figure 8:
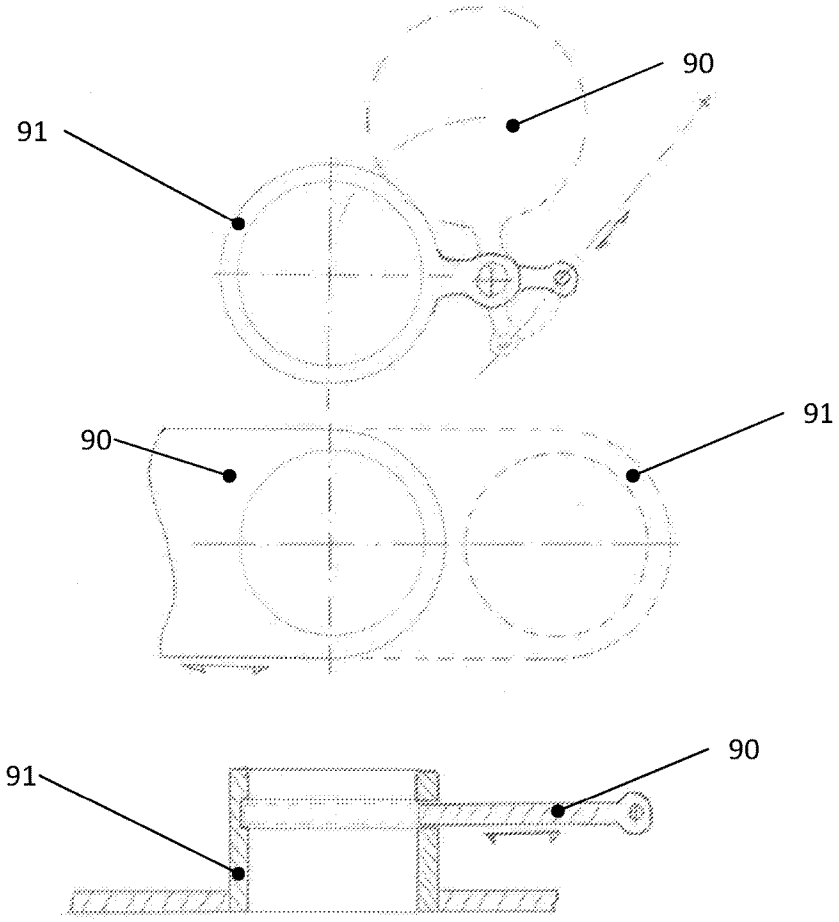

FIG. 8 shows that different way of closures associated to the piston 90 and the neck 91 are possible.

For example, piston 90 may act as a slide can be designed with many different shapes. A simple plate with higher movement range, or with holes or half-moon shaped openings that enclose the neck in open position.

Although the present invention has been fully described in connection with preferred embodiments, it is evident that modifications may be introduced within the scope thereof, not considering the application to be limited by these embodiments, but by the content of the following claims.

The invention claimed is:

1. A damper assembly for a combustion chamber of a gas turbine, the damper assembly comprising:

a hollow body provided with a neck, said hollow body is partitioned into fluidly communicating first and second damper cavities, wherein the first damper cavity has first movable elements;

a plug configured to engage the neck, said plug being mounted on a second movable element in the first damper cavity, wherein each movable element has an associated drive arrangement.

2. The damper assembly according to claim 1, wherein said hollow body comprises:

stop elements configured to limit a stroke of each movable element.

3. The damper assembly according to claim 1, wherein said first and second movable elements have a first position correspondent to a maximum volume and a second position correspondent to a minimum volume of at least one of said first and second damper cavity, respectively.

4. The damper assembly according to claim 1, wherein said at least one of said movable elements is bucket-shaped.

5. The damper assembly according to claim 1, wherein said first damper cavity is an inner cavity in fluid communication with said second damper cavity of said hollow body, said inner cavity having a variable volume through said first movable elements.

6. The damper assembly according to claim 1, wherein the plug has a first active position in which a combustion chamber will be in fluid communication with the second damper cavity, and a second closed position where said plug is inserted into said neck to deactivate said damper assembly.

7. The damper assembly according to claim 1, wherein each drive arrangement comprises:

a compressed air feeding system and a sealing element associated with said movable element.

8. The damper assembly according to claim 7, wherein a first compressed air feeding system is configured and arranged to feed compressed air in a pressurised gap delimited by a wall of one of said first movable elements and a back wall of said hollow body.

9. The damper assembly according to claim 8, wherein said sealing element is configured to seal said first and second damper cavities from said pressurised gap.

10. The damper assembly according to claim 9, wherein said sealing element is a compensator arranged around said first and second movable elements and disposed along an internal wall of said hollow body.

11. The damper assembly according to claim 7, wherein said sealing element is made of a resilient material.

12. The damper assembly according to claim 7, wherein a second compressed air feeding system is configured and arranged to feed compressed air in a pressurised gap delimited by an inner wall of one of said first movable elements and an outer wall of another of said first movable elements.

13. The damper assembly according to claim 12, wherein a third compressed air feeding system is configured and arranged to feed compressed air in a pressurized gap delimited by an inner wall of the another of said first movable elements and a wall of said second movable element.

* * * * *